US008657516B2

(12) United States Patent
Cagnina et al.

(10) Patent No.: US 8,657,516 B2
(45) Date of Patent: Feb. 25, 2014

(54) SURFACE TREATING IMPLEMENT HAVING LOCKING MEANS

(75) Inventors: Alessandro Cagnina, Mira (IT); Giuseppe DiBono, Mira (IT); Tangent Lu, Dongguan (CN)

(73) Assignee: Reckitt Benckiser N.V., Hoofddorp (NL)

( * ) Notice: Subject to any disclaimer, the term of this patent is extended or adjusted under 35 U.S.C. 154(b) by 328 days.

(21) Appl. No.: 12/804,614

(22) Filed: Jul. 26, 2010

(65) Prior Publication Data

US 2011/0107545 A1 May 12, 2011

(30) Foreign Application Priority Data

Aug. 1, 2009 (GB) ..... 0913488.3

(51) Int. Cl.
*A46B 11/00* (2006.01)

(52) U.S. Cl.
USPC ..... 401/190; 401/140; 401/138; 222/635

(58) Field of Classification Search
CPC ..... A46B 11/00
USPC ..... 15/403, 320; 222/635, 630, 146.3, 222/402.11; 401/138, 140, 190, 279, 280, 401/281
IPC ..... A46B 11/00
See application file for complete search history.

(56) References Cited

U.S. PATENT DOCUMENTS

| | | | | | |
|---|---|---|---|---|---|
| 2,649,331 | A | * | 8/1953 | Peltz et al. | 137/624.14 |
| 3,254,807 | A | * | 6/1966 | Rios et al. | 222/394 |
| 3,303,970 | A | * | 2/1967 | Breslau et al. | 222/134 |
| 3,575,319 | A | * | 4/1971 | Safianoff | 222/135 |
| 3,592,364 | A | * | 7/1971 | Thornton | 222/143 |
| 3,659,791 | A | * | 5/1972 | Clark | 239/375 |
| 3,738,536 | A | * | 6/1973 | Gach | 222/153.1 |
| 3,765,573 | A | * | 10/1973 | Landsman | 222/182 |
| 3,848,778 | A | * | 11/1974 | Meshberg | 222/402.11 |
| 3,967,763 | A | * | 7/1976 | Focht | 222/402.15 |
| 4,171,758 | A | * | 10/1979 | Corba | 222/402.11 |
| 4,506,808 | A | * | 3/1985 | Goncalves | 222/182 |
| 4,815,637 | A | * | 3/1989 | Nellis | 222/402.12 |

(Continued)

FOREIGN PATENT DOCUMENTS

| | | | | |
|---|---|---|---|---|
| EP | 62609 | A1 * | 10/1982 | B65D 83/14 |
| EP | 374339 | A1 * | 6/1990 | A47L 23/05 |
| GB | 2076899 | A * | 12/1981 | B65D 83/14 |
| JP | 54042855 | A | 4/1979 | |

OTHER PUBLICATIONS

English Language Abstract for JP54042855 taken from esp@cenet.com.

*Primary Examiner* — Joseph J Hail
*Assistant Examiner* — Marc Carlson
(74) *Attorney, Agent, or Firm* — Norris McLaughlin & Marcus PA

(57) ABSTRACT

A surface treating implement, comprises a body including:—
a container receiver;
a nozzle assembly comprising a fluid conduit fluidly connected to the container receiver;
a container mounted to the container receiver, containing a predetermined amount of a treating composition and having a dispensing opening in fluid communication with the fluid conduit;
wherein the body is associated with a handle which includes at least a portion of an activation means for the implement, characterized in that the fluid conduit includes a valve, wherein the valve is operable by a container member attached to and/or extending from the container, adjacent the dispensing opening.

10 Claims, 10 Drawing Sheets

(56) References Cited

U.S. PATENT DOCUMENTS

| | | | | | |
|---|---|---|---|---|---|
| 4,886,191 | A * | 12/1989 | Yoshitomi | 222/174 |
| 5,110,011 | A * | 5/1992 | Laska et al. | 222/82 |
| 5,180,109 | A * | 1/1993 | Schwartzbauer et al. | 239/346 |
| 5,368,202 | A * | 11/1994 | Smrt | 222/174 |
| 5,514,026 | A * | 5/1996 | Schaffer | 451/90 |
| 5,534,167 | A * | 7/1996 | Billman | 510/280 |
| 5,769,279 | A * | 6/1998 | Smrt | 222/174 |
| 5,826,795 | A * | 10/1998 | Holland et al. | 239/318 |
| 5,915,598 | A * | 6/1999 | Yazawa et al. | 222/402.1 |
| 5,924,599 | A * | 7/1999 | Brown | 222/135 |
| 6,053,373 | A * | 4/2000 | Sutton et al. | 222/402.13 |
| 6,056,213 | A * | 5/2000 | Ruta et al. | 239/337 |
| 6,082,588 | A * | 7/2000 | Markey et al. | 222/137 |
| 6,497,525 | B1 * | 12/2002 | Huang | 401/138 |
| 6,663,306 | B2 * | 12/2003 | Policicchio et al. | 401/138 |
| 6,663,307 | B2 * | 12/2003 | Kopanic et al. | 401/190 |
| 6,868,989 | B2 * | 3/2005 | Fahy et al. | 222/174 |
| 7,007,338 | B2 * | 3/2006 | Garabedian et al. | 15/231 |
| 7,021,499 | B2 * | 4/2006 | Hansen et al. | 222/145.5 |
| 7,048,458 | B2 * | 5/2006 | Hall et al. | 401/140 |
| 7,163,349 | B2 * | 1/2007 | Policicchio et al. | 401/137 |
| 7,204,041 | B1 * | 4/2007 | Bailey et al. | 36/29 |
| 7,337,989 | B1 * | 3/2008 | Penner et al. | 239/263.1 |
| 7,631,783 | B1 * | 12/2009 | Laible | 222/153.04 |
| D613,918 | S * | 4/2010 | Benacquisto | D32/39 |
| 7,708,485 | B2 * | 5/2010 | Tanaka et al. | 401/138 |
| 8,267,607 | B2 * | 9/2012 | Harris | 401/139 |
| 8,276,832 | B2 * | 10/2012 | Nelson et al. | 239/391 |
| D686,383 | S * | 7/2013 | Di Bono et al. | D32/38 |
| 8,475,070 | B1 * | 7/2013 | Miner et al. | 401/190 |
| 2001/0046407 | A1 * | 11/2001 | Kunkler et al. | 401/140 |
| 2002/0187908 | A1 * | 12/2002 | Gagilardi et al. | 510/278 |
| 2003/0029931 | A1 * | 2/2003 | Zanma et al. | 239/251 |
| 2003/0053845 | A1 * | 3/2003 | Aberegg et al. | 401/138 |
| 2003/0053846 | A1 * | 3/2003 | Kopanic et al. | 401/138 |
| 2003/0150448 | A1 * | 8/2003 | Bacon et al. | 128/200.23 |
| 2004/0028458 | A1 * | 2/2004 | Heathcock et al. | 401/190 |
| 2004/0063600 | A1 * | 4/2004 | Williams et al. | 510/375 |
| 2004/0178284 | A1 * | 9/2004 | Fahy et al. | 239/228 |
| 2004/0253041 | A1 * | 12/2004 | Hall et al. | 401/140 |
| 2005/0089360 | A1 * | 4/2005 | Garabedian et al. | 401/279 |
| 2005/0112022 | A1 * | 5/2005 | Morgan | 422/28 |
| 2006/0201970 | A1 * | 9/2006 | Jasek | 222/153.11 |
| 2007/0020040 | A1 | 1/2007 | Sacks | |
| 2007/0199952 | A1 * | 8/2007 | Carpenter et al. | 222/52 |
| 2007/0241134 | A1 * | 10/2007 | Gurrisi et al. | 222/153.11 |
| 2008/0152284 | A1 * | 6/2008 | Lytle et al. | 385/85 |
| 2008/0172828 | A1 * | 7/2008 | Butterbaugh | 15/424 |
| 2009/0249533 | A1 * | 10/2009 | Sawalski et al. | 4/223 |
| 2009/0293921 | A1 * | 12/2009 | Bown et al. | 134/104.2 |
| 2011/0041882 | A1 * | 2/2011 | Duffield et al. | 134/198 |
| 2011/0146720 | A1 * | 6/2011 | Huffman | 134/21 |
| 2011/0220685 | A1 * | 9/2011 | Lind et al. | 222/402.11 |
| 2011/0266310 | A1 * | 11/2011 | Tomkins et al. | 222/402.13 |
| 2012/0006858 | A1 * | 1/2012 | Rovelli | 222/402.13 |
| 2012/0093563 | A1 * | 4/2012 | Ganeson et al. | 401/25 |
| 2012/0103326 | A1 * | 5/2012 | Karle et al. | 128/200.21 |
| 2012/0192894 | A1 * | 8/2012 | Kubicek | 134/6 |
| 2012/0204377 | A1 * | 8/2012 | White et al. | 15/322 |
| 2012/0217243 | A1 * | 8/2012 | Cohen et al. | 220/200 |
| 2013/0283543 | A1 * | 10/2013 | Cagnina et al. | 8/137 |

* cited by examiner

SURFACE TREATING IMPLEMENT HAVING LOCKING MEANS

The patent or application file contains at least one drawing executed in color. Copies of this patent or patent application publication with color drawing(s) will be provided by the Office upon request and payment of the necessary fee.

The present invention relates to a surface cleaning implement.

Surface cleaning implements are extremely commonplace. For floor surface cleaning operations these generally take the forms of devices comprising one or more of brushes, fluid delivery systems, vacuuming motors and combinations of these elements.

In domestic environments the surfaces to be cleaned generally include fabric covered areas such as areas covered by rugs or carpets. For these areas the surface cleaning implements generally include a brush element and a fluid delivery reservoir. The fluid is brought into contact with the fabric surface, often allowed time to dry/address the fabric surface and then removed.

The fluid reservoir may be driven by gravity and thus may be simple filled by a user. More often, however, the fluid reservoir comprises a compressed system and is thus best served by a replaceable aerosol canister. Such canisters allow for the delivery of cleaning formulations under pressure thus aiding foam formation which can be beneficial and/or carpet fibre penetration.

It is an object of the present invention to provide an improved surface cleaning implement.

According to a first aspect of the invention there is provided a surface treating implement, comprising a body including:— a container receiver;

a nozzle assembly comprising a fluid conduit fluidly connected to the container receiver;

a container mounted to the container receiver, containing a predetermined amount of a treating composition and having a dispensing opening in fluid communication with the fluid conduit;

wherein the body is associated with a handle which includes at least a portion of an activation means for the implement, characterised in that the fluid conduit includes a valve, wherein the valve is operable by a container member attached to and/or extending from the container, adjacent the dispensing opening.

It has been found that the surface cleaning implement has excellent properties. These include the prevention/inhibition of fitment of an incorrect container onto the device. In this way damage to the surface being treated and/or potentially dangerous exposure of the user of the device to substances other than those intended to be used with the device are reduced. Additionally by having a strong positive grip on the container the device of the invention ensures that disconnection of the container from the device when treating a surface is avoided.

Preferably the container comprises an aerosol canister. Generally this is inserted into the container receiver in an invented position with its dispensing opening facing downwards when in an operating orientation.

Generally the container member comprises a bayonet projection. The container member is preferably arranged adjacent to the collar of the aerosol canister.

Preferably the valve comprises a rotation valve. The rotation valve is generally operated by (firstly) insertion of the container member into a receiving orifice or by locating the container member adjacent to a valve member. Then rotation of the aerosol canister by cooperation of the container member with the receiving orifice/valve member causes rotation of a portion of the rotation valve. The rotatable portion of the rotation valve preferably includes a portion of the fluid conduit. Thus rotation of the rotatable portion of the rotation valve enables the fluid conduit (from the dispensing opening to the nozzle assembly) to be complete such that treating composition can be dispensed.

(Removal of the container member comprises a similar operation in reverse).

Over rotation of the container may be prevented by the provision of a stop against which the container member may abut when sufficient rotation has occurred. The stop may take the form of a protective plate disposed above/adjacent the valve. The protective plate preferably has one or more apertures to permit insertion of the container member such that it can co-operate with the valve whilst at the same time only permitting a certain degree of rotation of the container member. The degree of rotation may be controlled by the size of the apertures in the protective plate and/or by the (complementary) design of the container member.

In an embodiment of the device the pivot is associated with a locking means.

According to a second aspect of the invention there is provided a surface treating implement, comprising a body including:— a container receiver;

a nozzle assembly comprising a fluid conduit fluidly connected to the container receiver;

a container mounted to the container receiver, containing a predetermined amount of a treating composition and having a dispensing opening in fluid communication with the fluid conduit;

wherein the body is associated with a handle which includes at least a portion of an activation means for the implement, characterised in that the fluid conduit includes a locking means, wherein the locking means is activated/deactivated by a container member attached to and/or extending from the container, adjacent the dispensing opening.

Preferably the container comprises an aerosol canister. Generally this is inserted into the container receiver in an invented position with its dispensing opening facing downwards when in an operating orientation.

Preferably the locking means is bias into the locking position, e.g. by a spring.

The locking means may comprise a barrel into which a latch penetrates, when in a locking position. An end of the barrel is intended to receive the canister end of the operating pivot. In this way (when the latch penetrates the lock barrel) the lock prevents movements of the aerosol canister end of the pivot up towards the aerosols canister. In this embodiment the latch engagement/disengagement motion is preferably linear.

Preferably the container member is able to push the latch out of penetrative engagement with the barrel such that the pivot is able to move into the barrel sufficiently to activate the aerosol. In a preferred embodiment the container member comprises a bayonet and the latch comprises a rod. The end of the rod which is intended to meet the bayonet is preferably angled such that increased movement of the bayonet against the rod causes a movement of the rod away from the bayonet. Preferably the movement of the bayonet against the rod is in a circular fashion. Alternatively the movement of the bayonet against the rod is in an axial/linear fashion. The movement of the bayonet may be within the barrel of the locking means. Most preferably the locking means has a pilot pathway which associates with a portion of the bayonet to guide the movement of the bayonet within the barrel. The pilot pathway may be disposed within the barrel or may be adjacent thereto. The pilot pathway may be in the form of an apertured plate which cooperates with the bayonet, only permitting the bayonet to pass through when the bayonet is orientated in a certain fashion reactive to the plate. The aperture of the plate and the bayonet may have complementary shapes to achieve this aim. Alternatively the pilot pathway may be in the form of a channel which cooperates with a button arranged on or adjacent the bayonet. Preferably the channel is arranged in a helical manner such that as the container member is pushed into the barrel it is rotated further with a greater degree of penetration. Preferably the channel terminates such that at maximum allowed penetration the container member and the latch are fully engaged and the lock mechanism is fully disengaged. (A plurality of buttons/associated channels may be present. Where this is the case the buttons are generally evenly spaced around the bayonet).

The latch may be disposed adjacent to the pilot pathway. In a locking position (when the latch engages/abuts against the pivotal operation system) movement of the aerosol canister end of the pivot (up towards the aerosol canister) is prevented. In this embodiment the latch engagement/disengagement motion is preferably rotational. The pivotal operation system may have a shoulder which is designed to cooperate with the latch.

Preferably the implement may be activated by a user when desired. Activation generally occurs via an activation means which preferably comprises an operating button that may be manually depressed (e.g. user a thumb) by a user. The operating button is preferably disposed on the handle which is connected to the body. The activation mechanism preferably includes a pivot mounted in the body and/or handle which may be pivoted to cause depression of an operating valve on the aerosol canister and hence release of the active substance. Preferably the pivot is bias into its non-activated position, e.g. by a spring.

The activation mechanism is preferably mechanical in nature. As examples the activation mechanism, may include a wire and/or a solid rod disposed between the operating button and the pivot. Activation of the operating button mechanism causes movement/tensioning of the rod/wire which in turn causes movement of the pivot. Preferably the rod and/or wire is disposed within the handle (between the operating button and the pivot) so that it cannot be damaged/disturbed by a user, in particular cannot be inadvertently operated by brushing against the handle.

It has been found that manual operation of the device is advantageous in that it allows a user to have a greater degree of control of the device, deciding when and where the contents of the container are to be discharged. This is especially important/relevant when compared to operating mechanisms driven by contact of the device with the surface being cleaned. With these devices the user has to exercise a greater degree of care when applying the device to a surface.

Preferably the body comprises a plastics material, e.g. polypropylene. Preferably the handle comprises a plastics material or a metallic material, e.g. aluminium.

Preferably the implement is for treatment of a fabric/textile material or a carpet. Usually the active substance comprises a carpet cleaning formulation. Most preferably the carpet cleaning formulation is released from the implement in the form of foam. Preferably the body of the implement includes a brushing means. The brush may be used to aid the dispersion of the carpet cleaning formulation into the fibres of the carpet being cleaned. Discharge of the container contents onto the carpet surface may be simultaneous with the brushing of the container contents into/onto the surface of the carpet. Alternatively the brushing operation may be delayed relative to the discharge operation. With the use of the handle operated activation mechanism separate/simultaneous brushing and discharge is facilitated when compared to brush head based activation systems.

According to a third aspect of the invention there is provided a cleaning operation for a fabric surface comprises the operation of an implement according to the first or second aspect of the invention on or near a fabric surface.

The cleaning operation may include a number of steps. A preferred form of a cleaning operation may comprise the following steps:— a) application of the composition to a stain, b) allowing the composition to absorb the stain, and c) removing the composition.

One cleaning operation is generally enough to treat most stains. In extreme cases multiple/repeated uses may be necessary.

Generally the composition is applied over the whole surface of the stain. For additional security the composition may be applied so that the area covered is slightly larger than the stain being treated and there is an overlap of the applied area of treatment composition onto some unsoiled material.

Generally the use is on a carpet/rug. Here the application finds most utility since carpets are notoriously easy to stain with food materials and at the same time are difficult to clean because of their size and [in many cases] being fixed in place.

Preferably the removal is with a domestic vacuum cleaner.

The invention will now be described with reference to the following non-limited figures in which:—

Figure 7A:
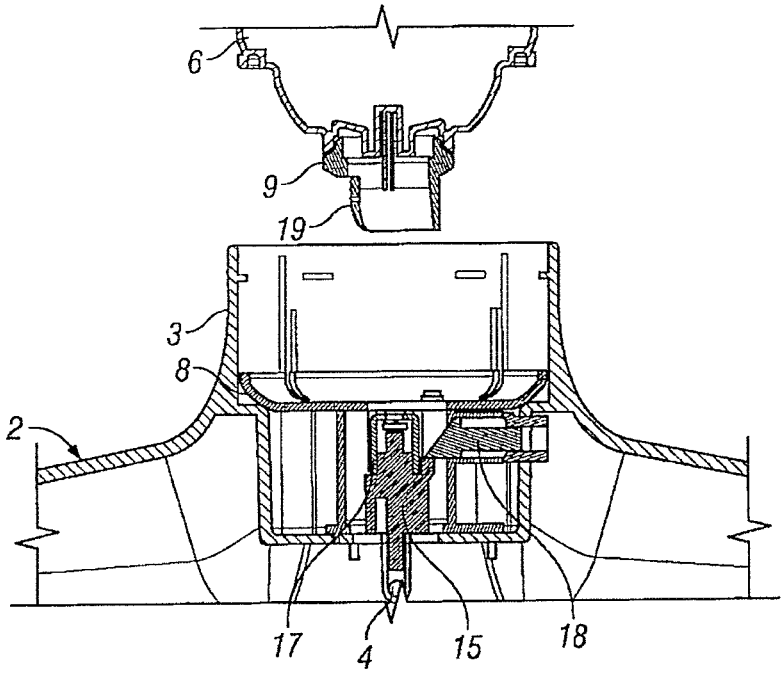
Figure 7B:
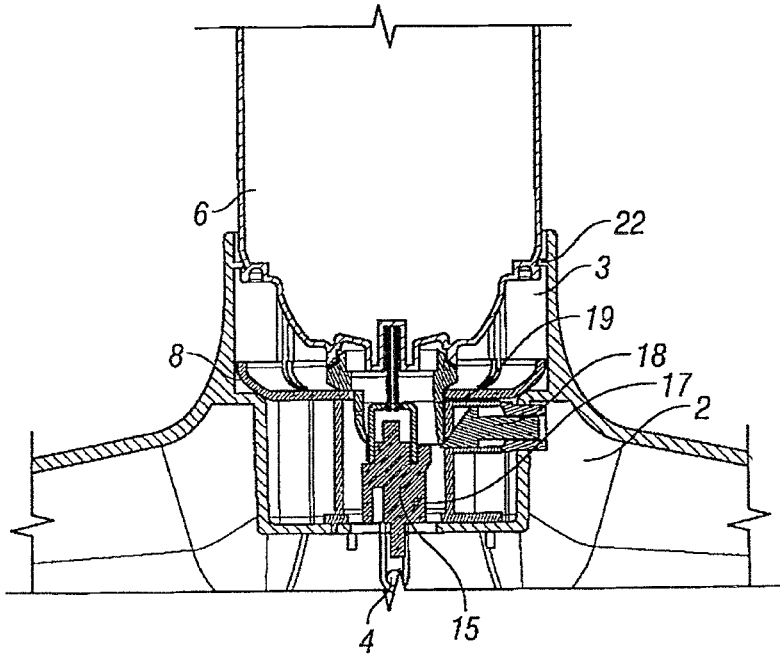
Figure 8:
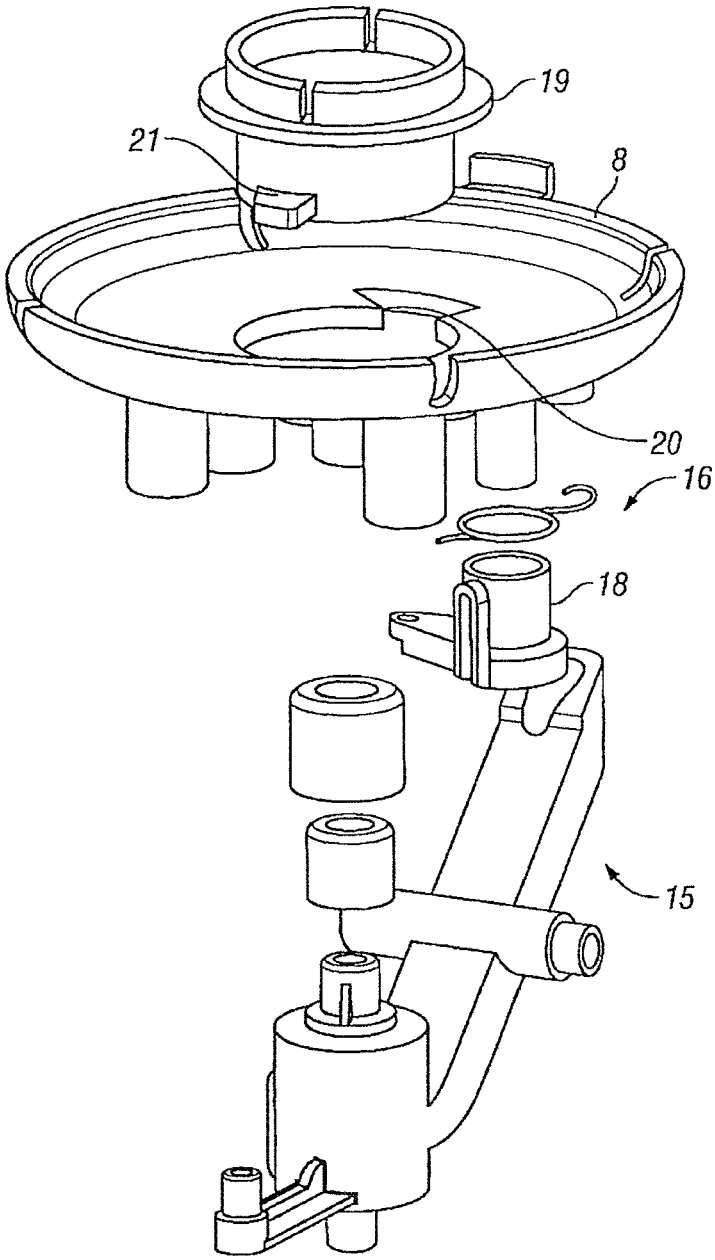
Figure 9A:
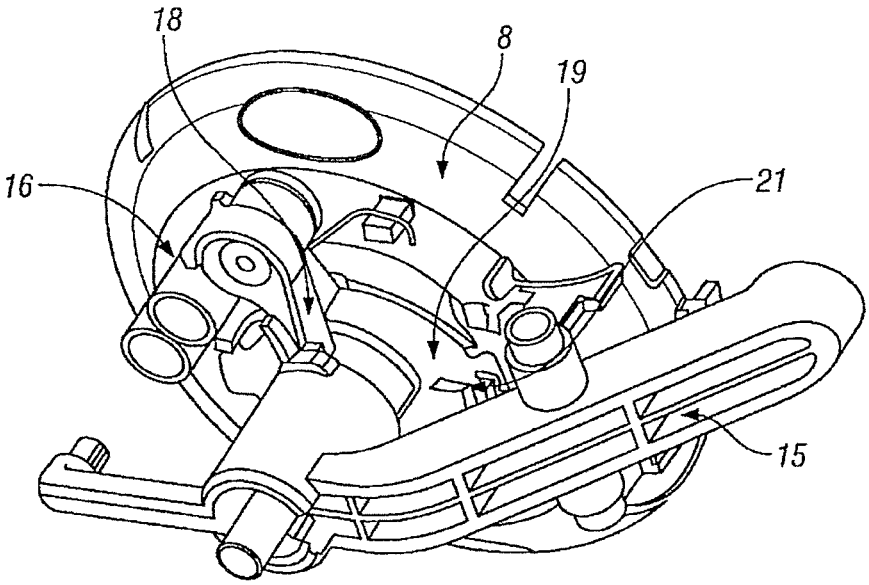
Figure 9B:
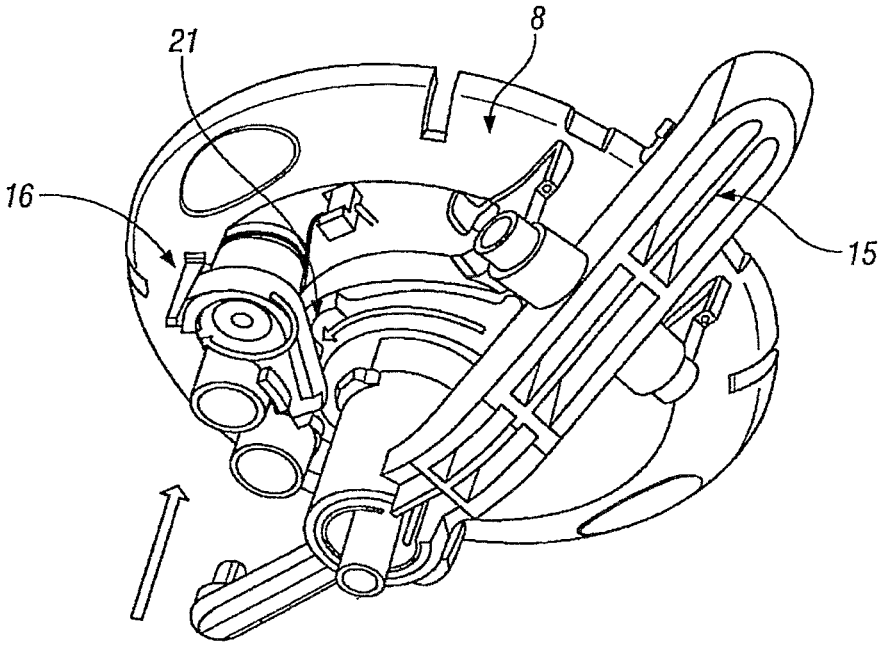

FIG. 7*a* is a cross-sectional view of a third embodiment of the invention;

FIG. 7*b* is a cross-sectional view of a third embodiment of the invention;

FIG. 8 is an exploded view of a fourth embodiment of the invention;

FIG. 9*a* is a view of a fourth embodiment of the invention;

FIG. 9*b* is a view of a fourth embodiment of the invention.

Figure 1:
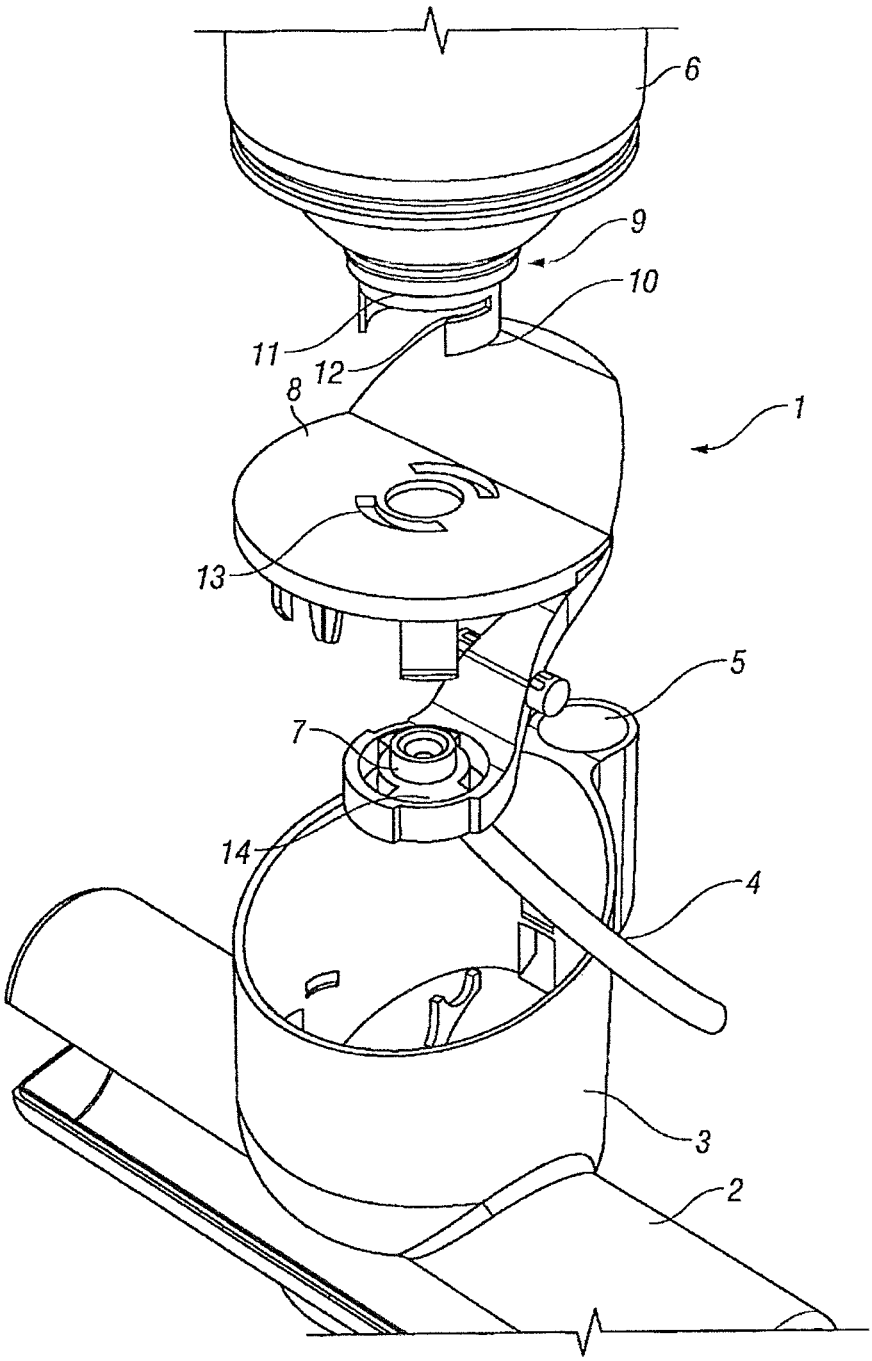
FIG. 1 and FIG. 10 are an exploded view of a first embodiment of the invention.
Figure 2:
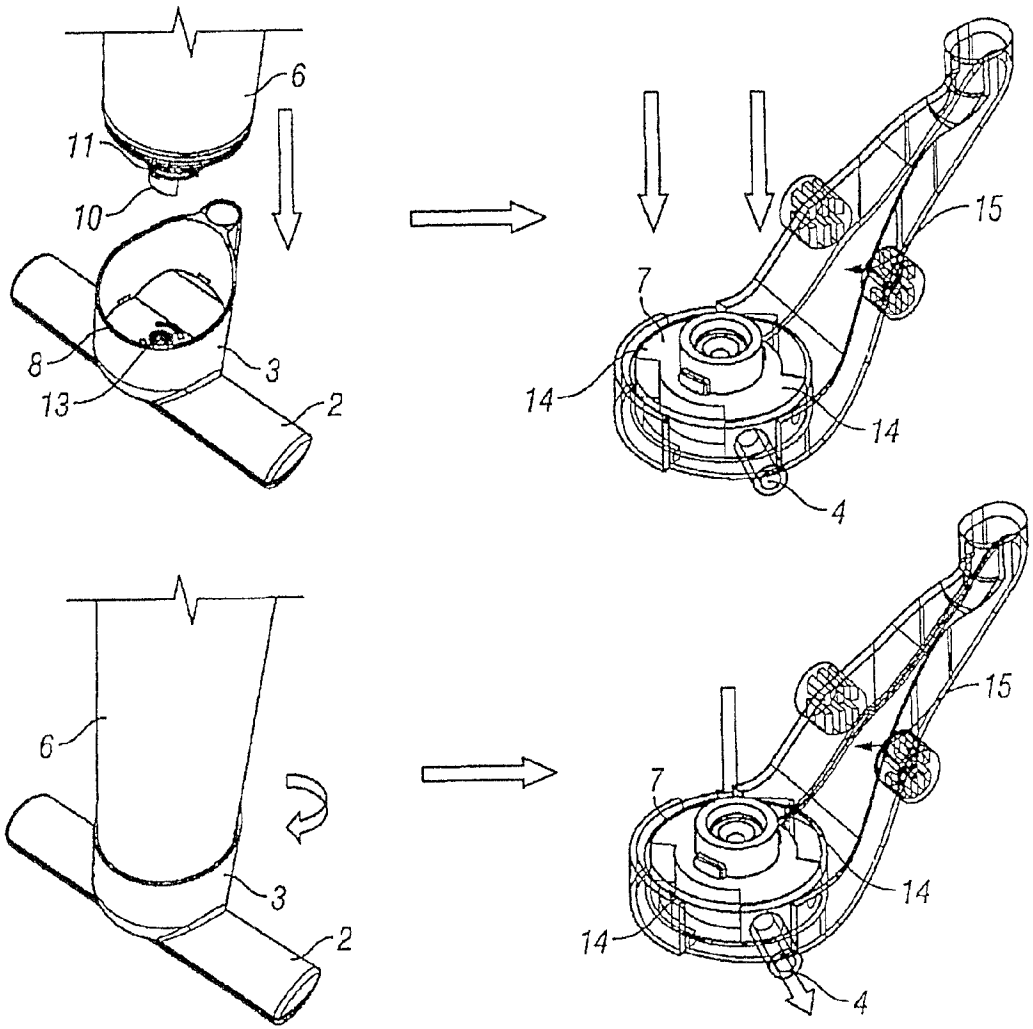
FIG. 2 is an exploded view of a first embodiment of the invention.
Figure 10:
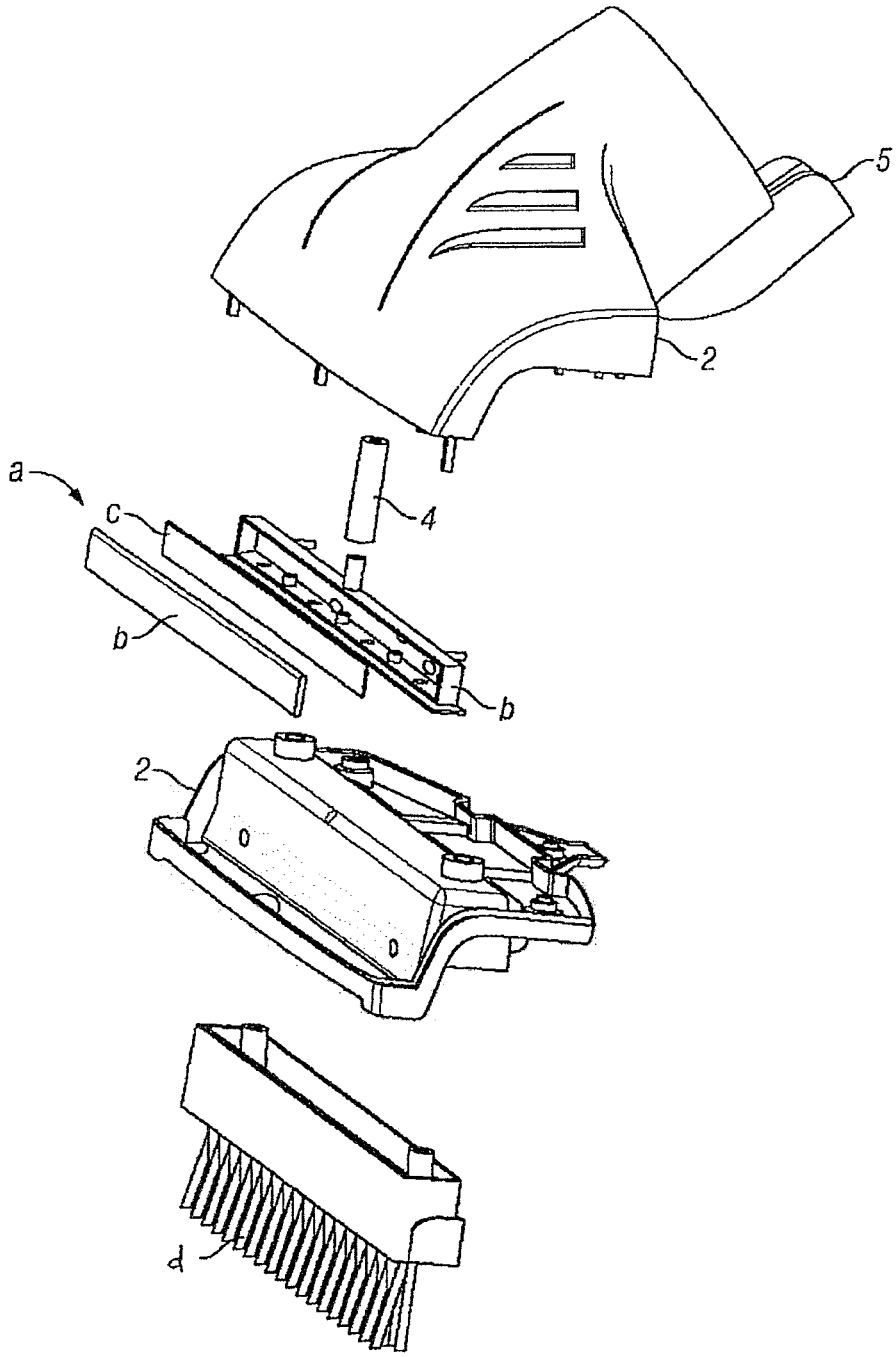

With reference to FIGS. 1, 2 and 10 it can be seen that the device (1) of the invention comprises a two-part body (2). The body (2) includes a cylindrical container receiver (3) and a nozzle assembly (a).

The nozzle assembly (a) comprises a fluid conduit (4) fluidly connected to the container receiver. The nozzle assembly further comprises a manifold assembly (b) which includes a foam core (c). The manifold assembly (b) is arranged towards the front of the body (2)

The body (2) has an associated brush section (d) mounted thereon.

The body has a handle (not shown) which can be accommodated by a handle receiving aperture (5).

In assembly a container (6) (an inverted aerosol canister) is mounted to the container receiver (3). The container (6) contains a predetermined amount of a treating composition and having a dispensing opening (not shown) in fluid communication with the fluid conduit (4).

The fluid conduit (4) includes a rotation valve (7). The rotation valve is disposed under a cover plate (8). The rotation valve (7) is operable by a container member (9) attached to and extending from the container (6), adjacent the dispensing opening. The container member is in the form of a pair of horns (10) extending from a cylindrical base (11). The horns (10) have an incision (12) adjacent the base (11).

The rotation valve (7) is operated by insertion of the container member horns (10) into receiving apertures (13) in the cover plate (8). Further insertion occurs until the horns (10) abut against valve operating members (14).

Then by rotation of the container (6), rotation of the horns (10) of the container member (9) occurs, which in turn causes rotation of the valve operating members (14). This opens the fluid conduit (4). Over rotation of the container (6) is prevented when the incision (12) of the horns (10) abuts against the cover plate (8).

In this position the operation of the container (6) may occur to cause dispense of the container (6) contents through the fluid conduit (4). (The full operation mechanism is not shown. However a pivot (15) which comprises a portion of the operating mechanism is shown).

Figure 3:
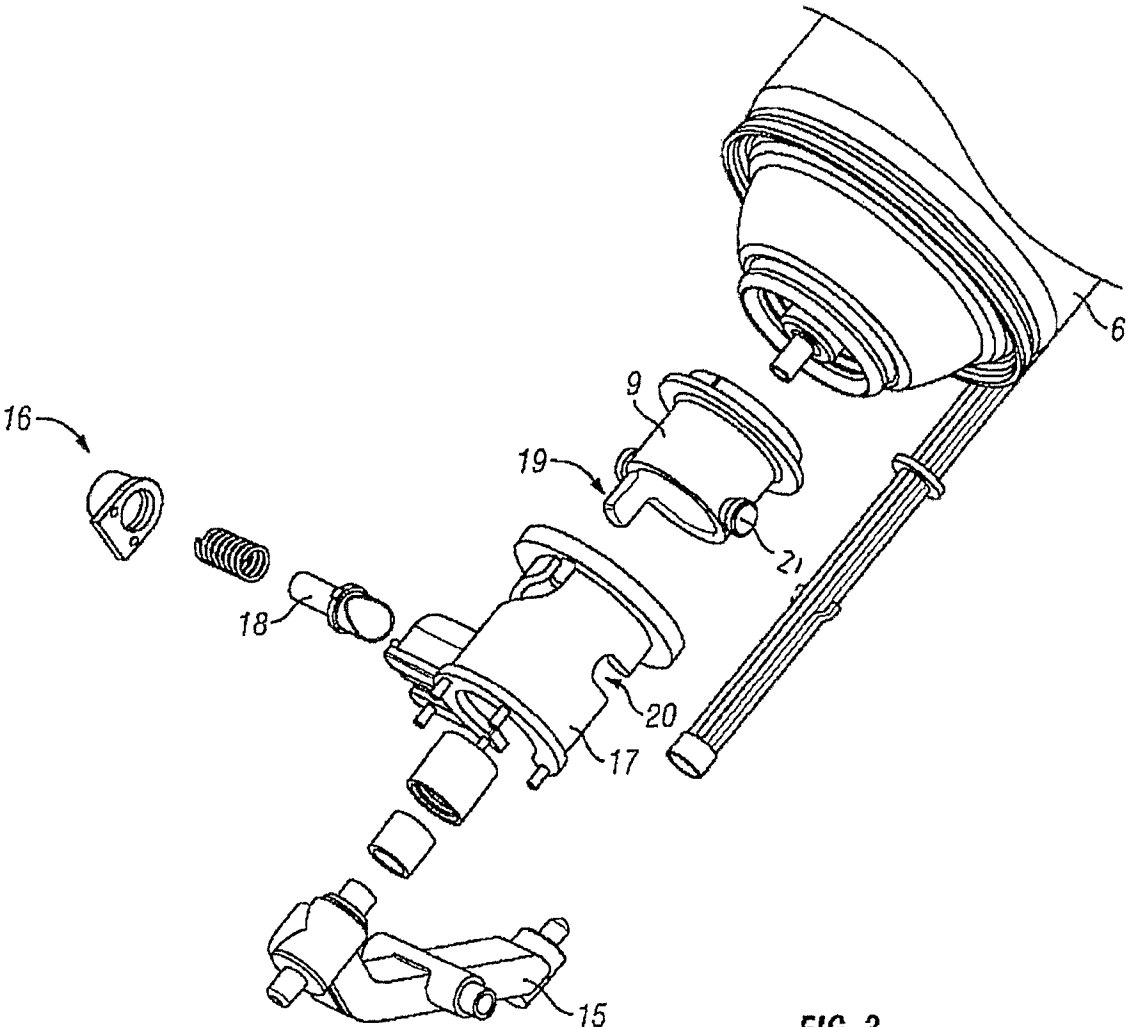
FIG. 3 is an exploded view of a second embodiment of the invention.
Figure 4:
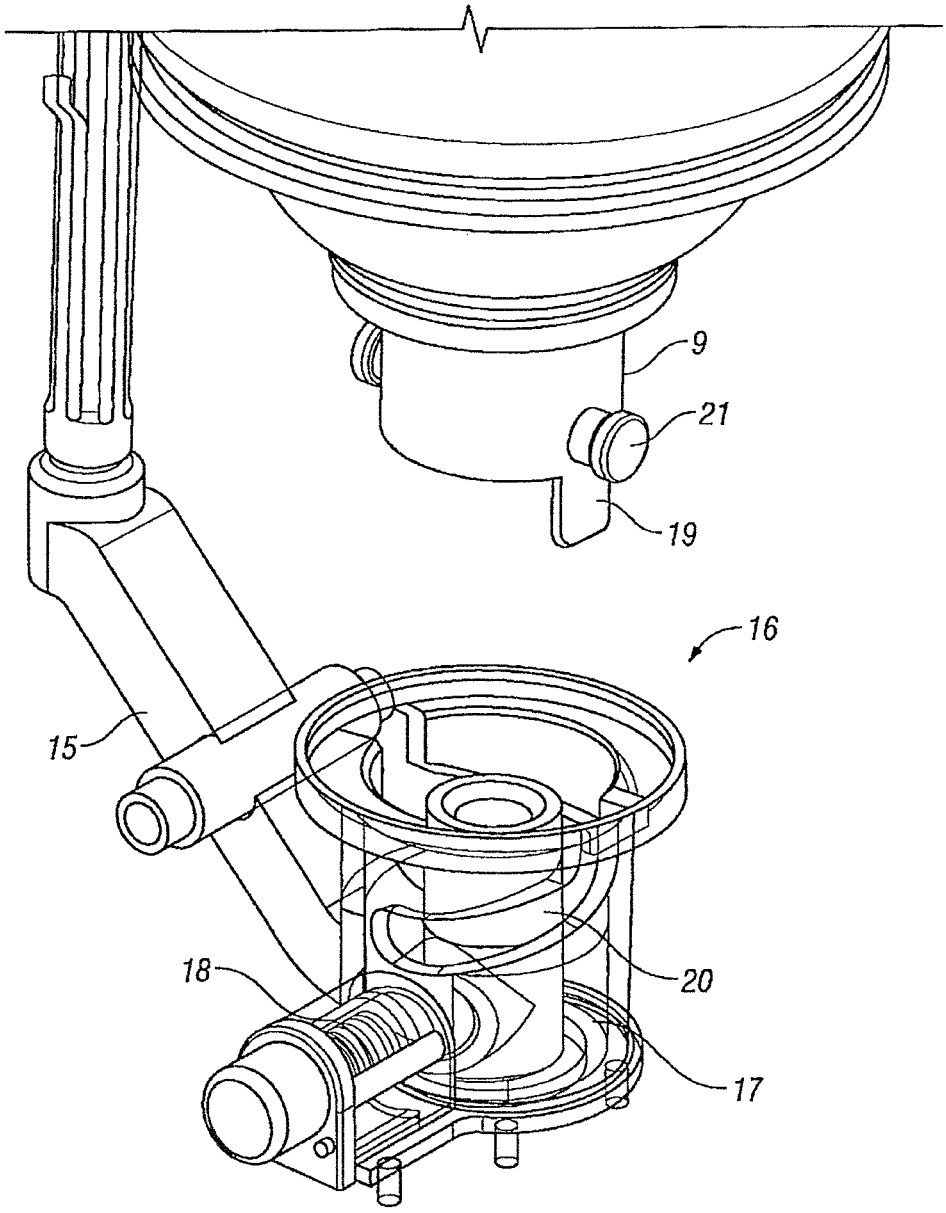
FIG. 4 is an exploded view of a second embodiment of the invention.
Figure 5:
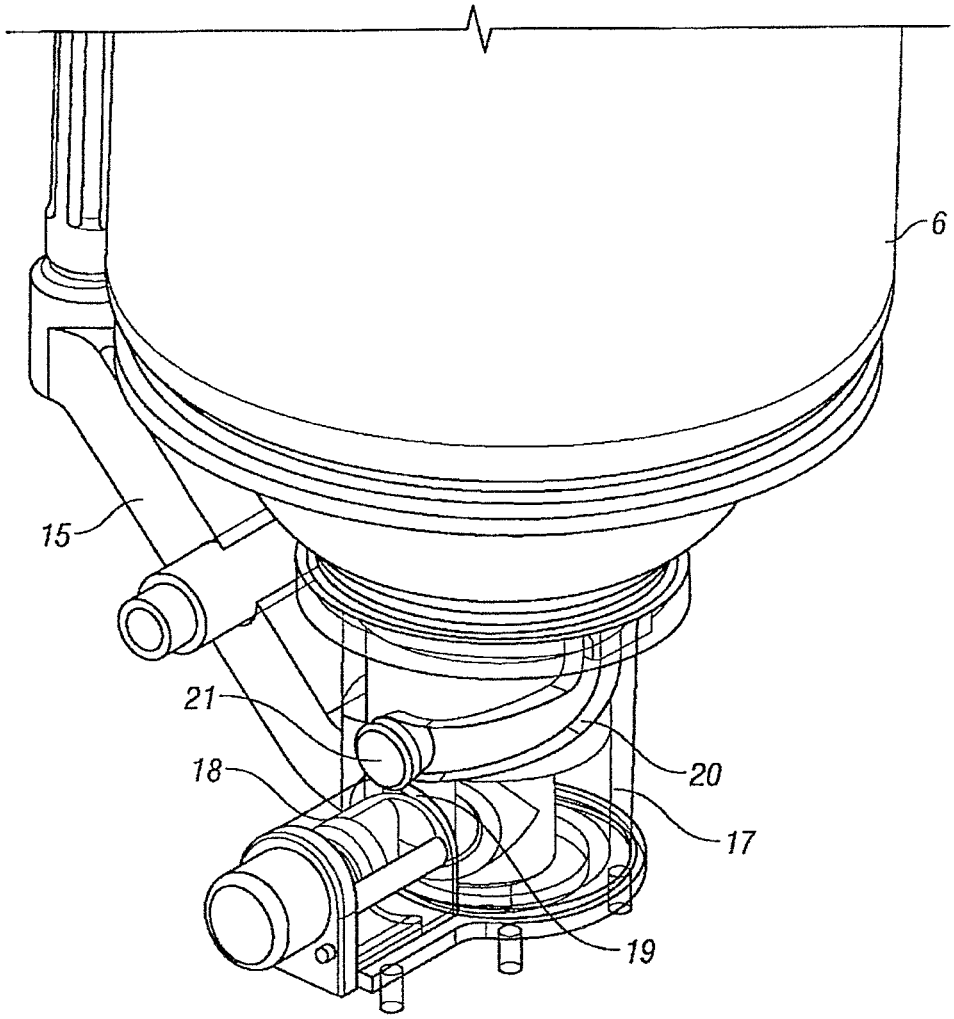
FIG. 5 is a cross-sectional view of a second embodiment of the invention.

With reference to FIGS. 3 to 5 it can be seen that the device (1) of the invention comprises a locking means (16).

The locking means comprises a barrel (17) into which a rod-shaped latch (18) penetrates, when in a locking position. An end of the barrel (17) is intended to receive the canister end of an operating pivot (15). In this way (when the latch (18) penetrates the lock barrel (17)) the lock prevents movement of the aerosol canister end of the pivot (15) up towards the aerosol canister (6).

The container member (9) comprises a bayonet (19). The end of the latch (18) which is intended to meet the bayonet (19) is angled such that movement of the bayonet (19) against the latch (18) causes a movement of the latch (18) away from the bayonet (19). The movement of the bayonet (19) against the latch (18) is in a circular fashion within the barrel (17) of the locking means (16). To achieve this, the barrel (17) of the locking means (16) has a pilot pathway (20), in the form of an incised channel, which associates with a button (21) arranged on or adjacent the bayonet (19). The pilot pathway (20) is arranged in a helical manner such that as the container member (9) is pushed into the barrel (17) it is rotated further with a greater degree of penetration. The pilot pathway (20) terminates such that at maximum allowed penetration the container member (9) and the latch (18) are fully engaged and the lock mechanism (16) is fully dis-engaged.

In this position the operation of the container (6) may occur to cause dispense of the container (6) contents through the fluid conduit (4). (The full operation mechanism is not shown. However a pivot (15) which comprises a portion of the operating mechanism is shown).

Figure 6:
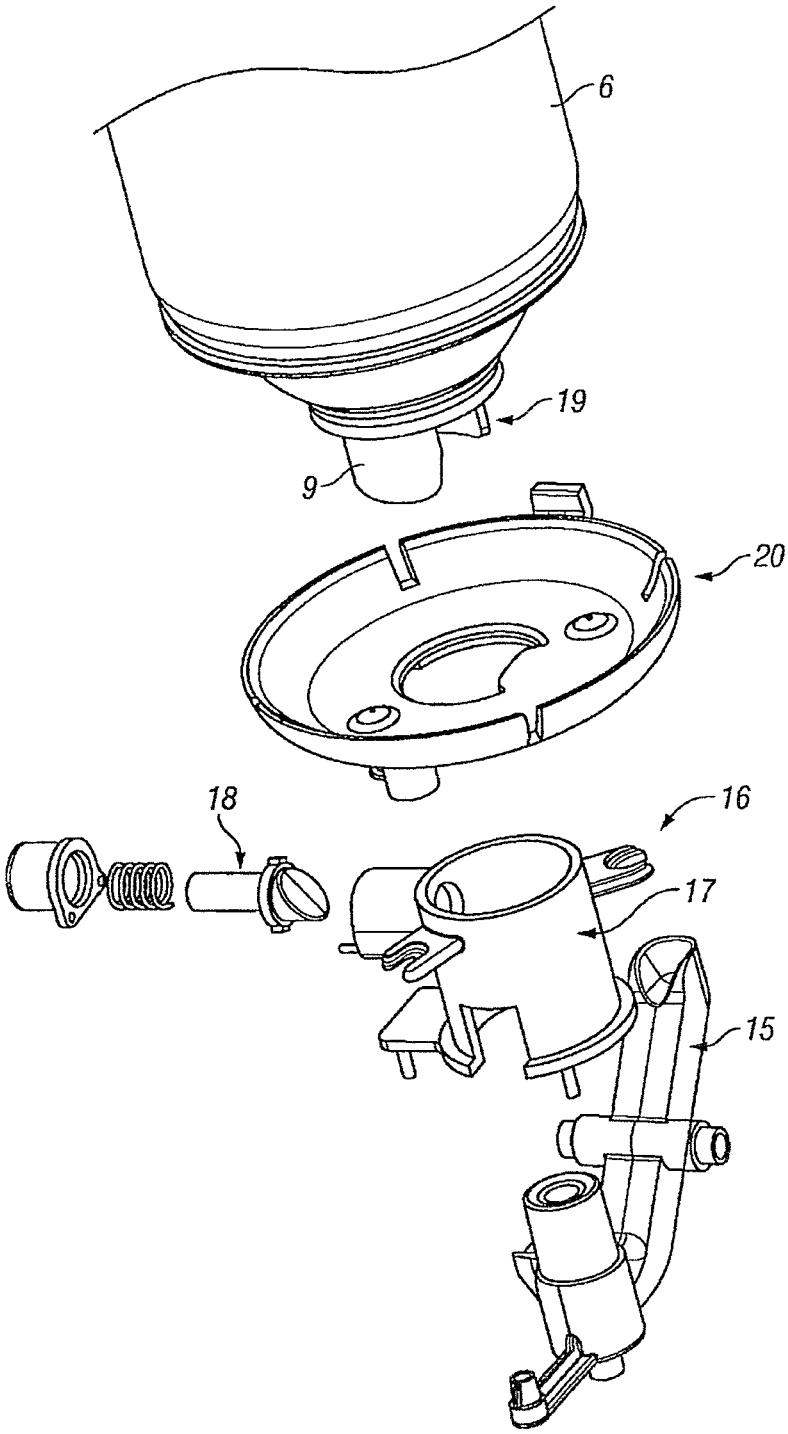
FIG. 6 is an exploded view of a third embodiment of the invention.

With reference to FIGS. 6, 7*a* and 7*b* it can be seen that the device (1) of the invention comprises a locking means (16).

The locking means comprises a barrel (17) into which a rod-shaped latch (18) penetrates, when in a locking position (bias into this position by a spring). An end of the barrel (17) is intended to receive the canister end of an operating pivot (15). In this way (when the latch (18) penetrates the lock barrel (17)) the lock prevents movement of the aerosol canister end of the pivot (15) up towards the aerosol canister (6). A shoulder of the pivot (15) abuts against the latch (18).

The container member (9) comprises a bayonet (19). The end of the latch (18) which is intended to meet the bayonet (19) is angled such that movement of the bayonet (19) against the latch (18) causes a movement of the latch (18) away from the bayonet (19). The movement of the bayonet (19) against the latch (18) is in a linear/axial fashion within the barrel (17) of the locking means (16). To achieve this, the barrel (17) of the locking means (16) has a pilot pathway (20), in the form of a shaped/orificed plate, which associates with the bayonet (19), such that the bayonet may only be introduced into the pilot pathway (20) when in a certain orientation. The pilot pathway (20) is arranged such that as the container member (9) is pushed into the barrel (17) at maximum allowed penetration the container member (9) and the latch (18) are fully engaged and the lock mechanism (16) is fully dis-engaged.

In this position the cylindrical container receiver (3) has a lip (22) which retains the container (6) (e.g. by resiliently holding a rim thereof).

In this position the operation of the container (6) may occur to cause dispense of the container (6) contents through the fluid conduit (4). (The full operation mechanism is not shown. However a pivot (15) which comprises a portion of the operating mechanism is shown).

With reference to FIGS. 8, 9*a* and 9*b* it can be seen that the device (1) of the invention comprises a locking means (16).

The locking means comprises a rod-shaped latch (18). The latch (18) is rotatable mounted (bias into the locking position by a spring). In this way the latch (18) prevents movement of the aerosol canister end of the pivot (15) up towards the aerosol canister (6). A shoulder of the pivot (15) abuts against the latch (18).

The container member (9) comprises a bayonet (19).

The locking means (16) has a pilot pathway (20), in the form of a shaped/orificed plate, which associates with a button (21) arranged on or adjacent the bayonet (19), such that the bayonet (19) may only be introduced into the pilot pathway (20) when in a certain orientation. The bayonet (19) may be pushed into the pilot pathway (20) such that the button (21) of the bayonet (19) becomes disposed on the opposite side of the pilot pathway (20) from the canister (6).

Once in this position the canister (6) may be rotated such that the button (21) of the bayonet (19) abuts against the latch. Continued movement causes disengagement of the latch (18) from engagement with the shoulder of the pivot (15).

In this position the operation of the container (6) may occur to cause dispense of the container (6) contents through the fluid conduit (4). (The full operation mechanism is not shown. However a pivot (15) which comprises a portion of the operating mechanism is shown).

The invention claimed is:

1. A surface treating implement, comprising:

a removable pressurized container comprising a valve cup and a protruding valve stem with a dispensing opening, said container containing a treatment composition; a container member adjacent the dispensing opening having a cylindrical base attached to the valve cup and extending therefrom and at least one slot and horn, or at least one bayonet protrusion;

a body which includes: a handle extending outwardly from the body; a container receiver for positioning the pressurized container in an inverted orientation with the valve stem downward; a nozzle assembly which is pivotably mounted and includes a fluid conduit; a shaped/orifice plate having a pilot pathway or aperture passing therethrough and a rotatably mounted locking latch which is biased into a locked position which locks the pivotable movement of the nozzle assembly from pivoting towards the container receiver when the pressurized container is not present within the surface treating implement or when the container member is not in proper engagement with the locking latch to disengage the locking latch from its locked position, wherein when the pressurized container is inserted into the container receiver such that a part of the container member is adjacent to or contacts the shaped/orifice plate and the horn or bayonet protrusion of the container member extends through the pilot pathway or aperture in the shaped/orifice plate, the rotation of the pressurized container and the container member causes the horn or bayonet protrusion of the container member to rotate the locking latch from its locked position to an unlocked position and to thereby release the nozzle assembly allowing the pivot to be operable and pivotable towards the valve stem of the pressurized container, and thereby causing the treatment composition to be dispensed from the container and through the fluid conduit, and in which the container member is oriented with respect to the shaped/orifice plate such that the pressurized container cannot be withdrawn from the container receiver.

2. A surface treating implement according to claim 1, in which the removable pressurized container is an aerosol canister.

3. A surface treating implement according to claim 1, wherein the body further includes: a manifold assembly in fluid communication with the fluid conduit, and with a nozzle assembly.

4. A surface treatment implement according to claim 1, wherein the body further includes: a brush.

5. A surface treatment implement according to claim 1, wherein the container member includes a bayonet projection.

6. A surface treatment implement according to claim 1, wherein the container includes a horn.

7. A surface treating implement according to claim 1, wherein the handle further comprises an operating button which is mechanically connected to the nozzle assembly.

8. A surface treating implement according to claim 7, wherein, when the operating button is pressed, the nozzle assembly is caused to pivot when the locking latch is disengaged by the container member from its locked position.

9. A method for the treatment of a fabric, a textile material or a carpet, which method comprises the steps of:

a) applying a composition from a surface treatment implement which comprises a removable pressurized container comprising a valve cup and a protruding valve stem with a dispensing opening, said container containing a treatment composition; a container member adjacent the dispensing opening having a cylindrical base attached to the valve cup and extending therefrom and at least one slot and horn, or at least one bayonet protrusion;

a body which includes: a handle extending outwardly from the body; a container receiver for positioning the pressurized container in an inverted orientation with the valve stem downward; a nozzle assembly which is pivotably mounted and includes a fluid conduit; a shaped/orifice plate having a pilot pathway or aperture passing therethrough and a rotatably mounted locking latch which is biased into a locked position which locks the pivotable movement of the nozzle assembly from pivoting towards the container receiver when the pressurized container is not present within the surface treating implement or when the container member is not in proper engagement with the locking latch to disengage the locking latch from its locked position, wherein when the pressurized container is inserted into the container receiver such that a part of the container member is adjacent to or contacts the shaped/orifice plate and the horn or bayonet protrusion of the container member extends through the pilot pathway or aperture in the shaped/orifice plate, the rotation of the pressurized container and the container member causes the horn or bayonet protrusion of the container member to rotate the locking latch from its locked position to an unlocked position and to thereby release the nozzle assembly allowing the pivot to be operable and pivotable towards the valve stem of the pressurized container, and thereby causing the treatment composition to be dispensed from the container and through the fluid conduit, and in which the container member is oriented with respect to the shaped/orifice plate such that the pressurized container cannot be withdrawn from the container receiver to a stain present on treated fabric, textile material or carpet, b) allowing the composition to absorb the stain; and, c) removing the composition from the treated fabric, textile material or carpet.

10. A method according to claim 9 in which the removal step (c) comprises removing the said composition with a vacuum cleaner.

* * * * *